United States Patent [19]

Latraverse

[11] Patent Number: 4,564,970

[45] Date of Patent: Jan. 21, 1986

[54] DEVICE FOR CARRYING OUT A PAINT TOUCH UP IN A CORNER

[76] Inventor: Germain Latraverse, R.R. 3, 160 Reid St. BM 26, Drummondville (Quebec), Canada, J2B 7T4

[21] Appl. No.: 648,978

[22] Filed: Sep. 10, 1984

[30] Foreign Application Priority Data

Jul. 3, 1984 [CA] Canada ..... 457977

[51] Int. Cl.[4] ..... B05C 17/02; B05C 21/00

[52] U.S. Cl. ..... 15/230.11; 15/248 A; 15/257 R; 118/504

[58] Field of Search ..... 15/248 A, 248 R, 257 R, 15/230.11; 118/504, 505

[56] References Cited

U.S. PATENT DOCUMENTS

| | | | |
|---|---|---|---|
| 624,796 | 5/1899 | Hardin . | |
| 1,434,903 | 11/1922 | Manning . | |
| 2,098,005 | 11/1937 | Holt | 118/504 |
| 2,332,579 | 10/1943 | Kirby | 15/257 R |
| 2,517,220 | 8/1950 | Lister | 118/504 |
| 2,754,799 | 7/1956 | Crawford | 118/504 |
| 3,330,253 | 7/1967 | Rowe | 118/504 |
| 3,623,180 | 11/1971 | Anderson | 15/230.11 |
| 4,051,808 | 10/1977 | Trupp | 118/504 |

FOREIGN PATENT DOCUMENTS

| | | | |
|---|---|---|---|
| 62045 | 3/1898 | Canada . | |
| 223810 | 9/1922 | Canada . | |
| 555814 | 4/1958 | Canada | 15/230.11 |
| 595064 | 3/1960 | Canada . | |
| 843656 | 6/1970 | Canada . | |
| 1132792 | 10/1982 | Canada . | |

*Primary Examiner*—Edward L. Roberts
*Attorney, Agent, or Firm*—Robic, Robic & Associates

[57] ABSTRACT

The present invention relates to a device for carrying out a paint touch up in a corner formed by the intersection of two planar sufaces disposed at right angle with respect to each other. Such a touch up device comprises a first part including a handle and provided with a rectangular plate for masking from the corner a portion of a first of the two surfaces. The touch up device also comprises a paint roller provided with a handle constituted by a rod and holding this roller at one end. The rod is bent in order to cooperate with a guiding system of the first part for the purpose of, when this first part masks the above-mentioned portion of the first surface, positioning the paint roller and guiding any movement along the corner transmitted to this roller through its handle so as to allow painting from the corner of a portion of the second of the two surfaces, which portion of the second surface corresponds to the portion of the first surface masked by the first part. Therefore, by appropriately handling the first part for masking from the corner a portion of the first surface, and the paint roller through its handle which cooperates with the guiding system, it is possible to paint from the corner a portion of the second surface without smearing the first surface protected by the rectangular plate of the first part, for thereby easily carrying out into practice the paint touch up. However, it should be pointed out that the use of the touch up device of the invention is not limited to paint but can also be used with any other coating applied in liquid state.

11 Claims, 3 Drawing Figures

FIG. 3
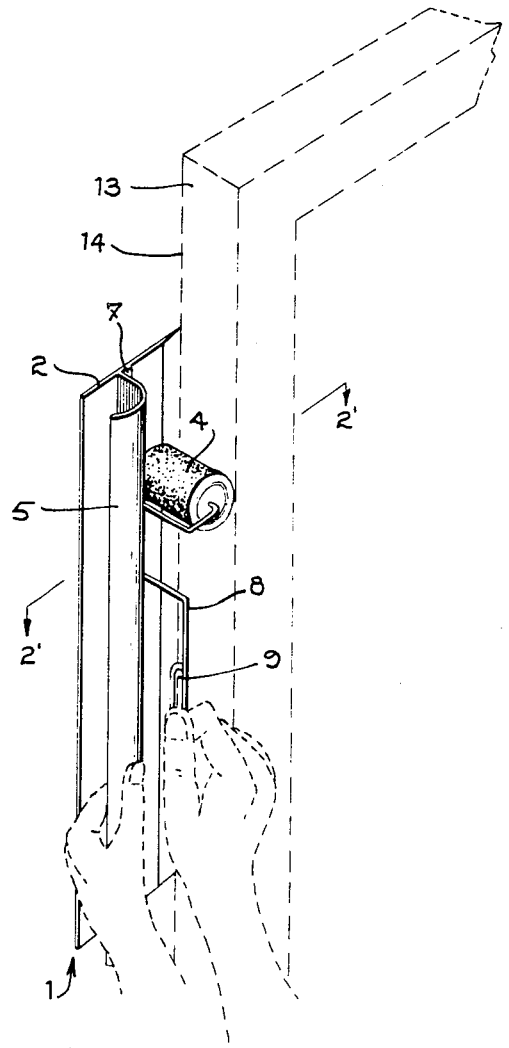
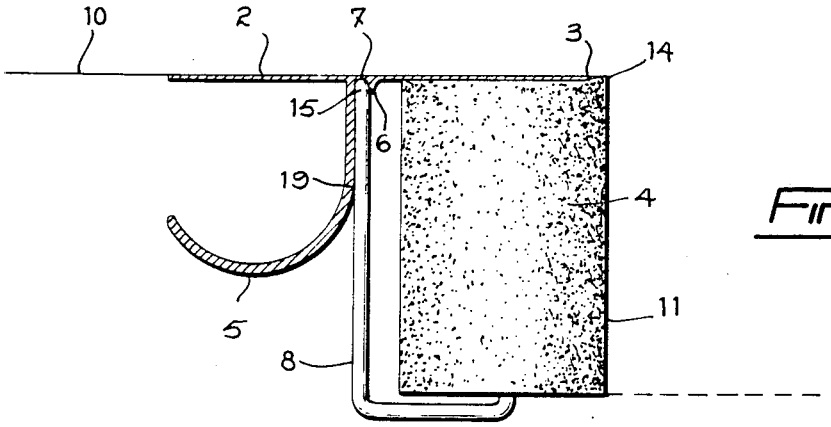
FIG. 2

DEVICE FOR CARRYING OUT A PAINT TOUCH UP IN A CORNER

BACKGROUND OF THE INVENTION

1. Field of the Invention

The present invention relates to a device for carrying out a touch up of paint, or of any other coating applied in liquid state, in a corner formed by the intersection of two substantially planar surfaces disposed substantially at right angle with respect to each other. More specifically, the device of the invention allows to coat, from the corner, with paint or with any other coating applied in liquid state a portion of one of the two surfaces and that without smearing the other of these two surfaces.

2. Brief Description of the Prior Art

Conventionally, it is used for carrying out such a touch up, a system designed to mask from the corner one of the two surfaces. After this system is installed, by appropriately operating a paint brush or a paint roller, it is possible to coat from the corner with paint or with any other coating applied in liquid state, the other of these two surfaces without smearing the masked surface for thereby carrying out the touch up. However, as these conventional systems are not provided with means for suitably positioning the brush or the roller and/or for guiding movement of the brush or of the roller, their use is often delicate and necessitates a certain skill as well as a lot of attention in the handling of the brush or of the roller.

SUMMARY OF THE INVENTION

An object of the present invention is therefore to overcome such a drawback by providing means for appropriately positioning and guiding movement of a paint roller used to carry out into practice a touch up of the above type, thereby facilitating its realization.

More particularly, according to the present invention, there is provided a device for carrying out a touch up of paint, or of any other coating applied in liquid state, in a corner formed by the intersection of two substantially planar surfaces disposed substantially at right angle with respect to each other, comprising:

a first part for masking a portion of a first of the two surfaces, which portion of the first surface lying from the corner and along this corner; and a paint roller provided with means for handling thereof.

The first part comprises means for allowing handling thereof as well as means for guiding the handling means of the paint roller. These handling means of the paint roller comprise means which, when the first part masks the portion of the first surface, cooperate with the guiding means of this first part for positioning the paint roller and for guiding any movement along the corner transmitted to the paint roller through its handling means so as to allow coating with paint, or with any other coating applied in liquid state, of a portion of the second of said two surfaces, this portion of the second surface lying from the corner and along this corner and corresponding to the portion of the first surface masked by the first part. Therefore, by handling the first part for masking the portion of the first surface and the paint roller through its handling means guided through the guiding means of the first part, it is possible to coat with paint, or with any other coating applied in liquid state, the portion of the second surface without smearing with paint, or with this other coating applied in liquid state the first surface protected by the mask formed by the first part, for thereby carrying out said touch up.

BRIEF DESCRIPTION OF THE DRAWINGS

The objects, advantages and other features of the present invention will become more apparent from the following non restrictive description of a preferred embodiment thereof, made with reference to the attached drawings in which:

FIG. 2 is a side, cross-sectional view of the preferred embodiment of the touch up device; and FIG. 3 illustrates the way to use the touch up device of the invention for, by example, painting a door frame or any other frame of a color other than the color of the surrounding wall.

DETAILED DESCRIPTION OF THE PREFERRED EMBODIMENT

Figure 1:
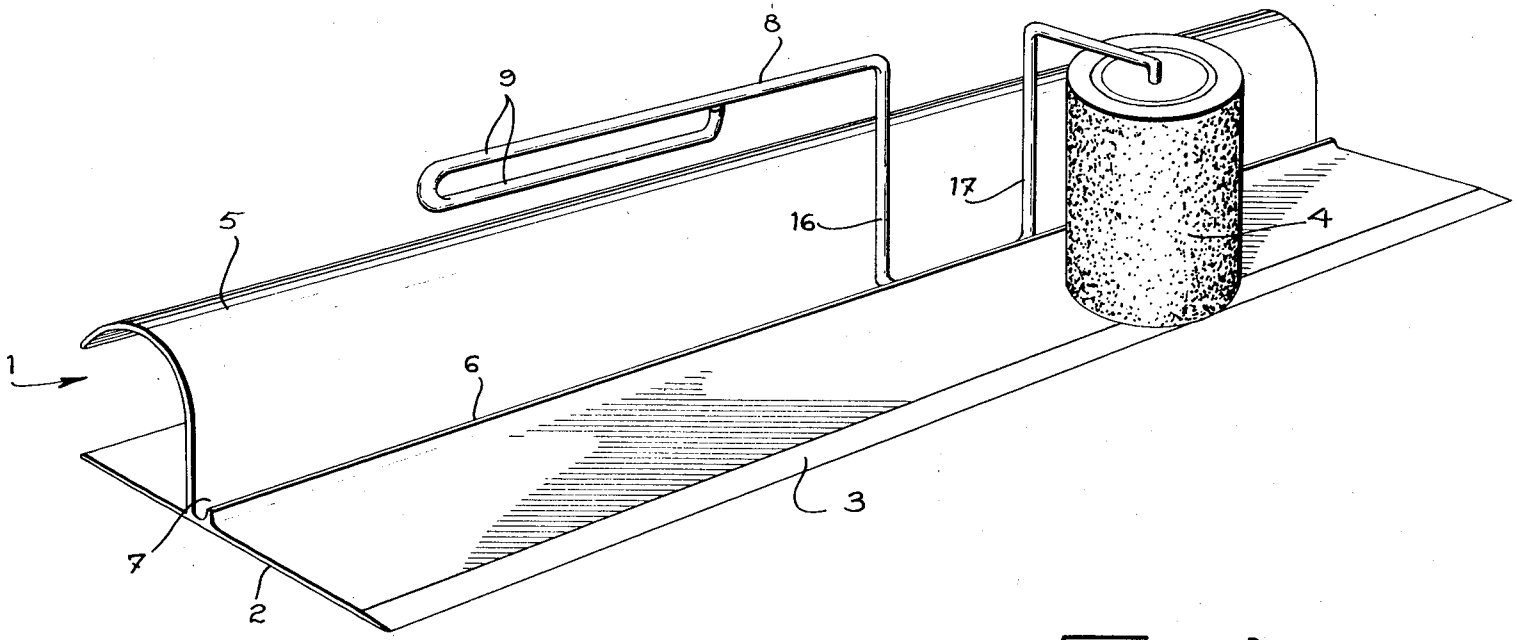
FIG. 1 is a perspective view of the preferred embodiment of the touch up device of the invention.

The preferred embodiment of the touch up device will now be described in detail with reference to FIGS. 1 and 2 of the drawings. It should be pointed out that the cross-sectional view of FIG. 2 is taken along the axis 2′—2′ of FIG. 3.

This embodiment will be defined hereinafter for an application to a paint touch up. However, it should be pointed out that it can also be used for a touch up of any other coating applied in liquid state.

The touch up device comprises a first part designated generally by the reference numeral 1, which part 1 may advantageously be made of a single piece and of plastics through an extrusion process.

The part 1 is provided with a thin and planar plate 2 designed for masking a surface 10 (FIG. 2) which must not be painted or smeared as will become more apparent from the following description. The plate 2 comprises a lateral sharpened edge 3 for a better operation of the touch up device. More specifically, this edge 3 allows to the plate 2, when it is adjusted in a corner 14 (FIG. 2) formed by two surfaces disposed substantially at right angle (90°) with respect to each other to mask directly from the corner 14 the surface 10. It is thus possible to paint of a different color the other surface 11 (FIG. 2) up to the corner 14 and that without smearing the surface 10 protected by the plate 2 through a paint roller 4 as will be seen in more detail hereinafter, for thereby carrying out into practice a color touch up from the corner 14. The sharpened edge 3 also eliminates any lateral surface of the plate 2 at this position, which surface would become coated with paint and would thereby render more difficult that utilization of the touch up device.

In conclusion, the sharpened edge 3 increases the efficiency of the touch up device and allows a more precise delimitation of the touch up.

The part 1 also comprises a handle 5 fixed to the plate 2 and allowing any user thereof to handle as required this part 1 of the touch up device.

A linear protuberance 6 of the part 1 defines with the handle 5 a linear groove 7 for guiding the handle 8 of the paint roller 4, of a standard type.

The handle 8 of the paint roller 4 is formed by a rod holding the roller 4 at one end and bent in order to define a U-shaped portion having a base 15 which can be inserted in the groove 7. When the plate 2 masks from the corner 14 a portion of the surface 10, and when the base 15 is inserted in the groove 7, this base 15 in the above described position and the legs 16 and 17 of the U-shaped portion cooperate with the groove 7 and the handle 5 for holding the paint roller 4 on the surface 11 to be painted and that up to the corner 14 as illustrated on FIG. 2. Therefore, the longitudinal axis of the paint roller 4 is positioned substantially at right angle (90°) with respect to the plate 2, and consequently, to the surface 10 masked by this plate 2.

More specifically, for holding the paint roller 4 in this appropriate position, the handle 5 of the part 1 and the groove 7 cooperate with the base 15 and the legs 16 and 17 for preventing the handle 8 and consequently the paint roller 4 to pivote backwards. In order to prevent such a pivoting movement, the legs 16 and 17 lean on the handle 5 (at 19, on FIG. 2).

The paint roller 4 being positioned as described above, and any movement thereof along the corner 14 being guided through its handle 8, it is therefore easy to paint the surface 11 up to the corner 14 for thereby easily carrying out into practice the desired paint touch up.

Of course, the handle 8 of the paint roller 4 is provided with grip means 9 for a manipulation thereof.

As illustrated on FIG. 3 of the drawings, the touch up device can be used for painting a frame 13, for example the frame of a door, of a color different from that of the surrounding wall (surface 10 on FIG. 2). The part 1 is then handled through its handle 5 in order to mask the surface of the surrounding wall (identified by the reference 10 on FIG. 2), from the corner 14 and the handle 8 of the paint roller 4 in order to be adjusted in the groove 7.

It is then evident that, when the part 1 masks from the corner 14 a portion of the surface of the surrounding wall and when the handle 8 positioned in the groove 7 is operated in a backward and forward motion guided by the groove 7, along the corner 14, it is possible to paint a portion of the periphery of the frame 13 (see surface 11 on FIG. 2) without smearing the surface of the surrounding wall for thereby carrying out the paint touch up.

By repeating the operation after the part 1 has been displaced, the complete periphery of the frame 13 can be painted without smearing the surface of the surrounding wall. Of course, the same process may be used for carrying out a paint touching up in a corner formed by two walls disposed at right angle with respect to each other.

Although the present invention has been described by way of a preferred embodiment thereof, it should be pointed out that any modification to this preferred embodiment can be made within the scope of the appended claims without changing or altering the inventive idea from which originates the present invention.

I claim:

1. A device for carrying out a paint touch up, or a touch up of another coating applied in liquid state, in a corner formed by the intersection of two substantially planar surfaces disposed substantially at right angle with respect to each other, comprising:

a shielding part for masking a portion of a first of said two surfaces, which portion of the first surface being adjacent said corner, said shielding part including (a) a linear edge adapted to be positioned in said corner, (b) a first side facing said portion of the first surface, (c) a second side opposite to said first side, and (d) a linear groove formed on the second side of the shielding part and parallel to said linear edge;

a paint roller; and means for handling said paint roller, said handling means including a rod having a first end on which the paint roller is mounted, said rod being bent to define a linear rod portion which is positioned into said linear groove of the shielding part in order to guide the paint roller while painting a portion of the second of said two surfaces or applying said other coating on said portion of the second surface, which portion of the second surface being adjacent said corner and contiguous to said portion of the first surface;

whereby, in operation, said portion of the second surface can be easily painted or coated with said other coating as the paint roller is guided through said linear groove and said linear rod portion, and that without smearing with paint or with said other coating the first surface having said portion thereof masked by the shielding part to thereby carry out said touch up.

2. A touch up device according to claim 1, wherein said shielding part comprises a substantially planar plate, said substantially planar plate being positioned flat against said first surface for masking said portion of this first surface.

3. A touch up device according to claim 2, wherein said plate is rectangular.

4. A touch up device according to claim 2, wherein said plate comprises a sharpened edge forming said linear edge of the shielding part.

5. A touch up device according to claim 1, wherein said shielding part is made in one piece.

6. A touch up device according to claim 1, in which said rod comprises a second end provided with grip means, which grip means forming part of said means for handling the paint roller.

7. A touch up device according to claim 1, wherein said paint roller has a longitudinal axis, and wherein said rod is bent for positioning said longitudinal axis of the paint roller substantially perpendicular to said first surface when said linear portion of the rod is positioned into the linear groove of the shielding part and when said shielding part masks said portion of the first surface.

8. A device for carrying out a paint touch up, or a touch up of another coating applied in liquid state, in a corner formed by the intersection of two substantially planar surfaces disposed substantially at right angle with respect to each other, comprising:

a shielding part for masking a portion of a first of said two substantially planar surfaces, which portion of said first surface being adjacent said corner, said shielding part comprising (a) a first, substantially planar plate having a linear edge adapted to be positioned in the corner, a third surface facing said portion of the first surface, and a fourth surface opposite to said third surface, (b) a handle formed by a second plate fixed to said first plate, which second plate extends from said fourth surface firstly in a plane parallel to said linear edge and substantially perpendicular to the first plate, and secondly following a curve towards the side opposite to said linear edge, and (c) a linear protuberance parallel to said linear edge, disposed on said fourth surface between said linear edge and said second plate, and defining with this second plate a linear groove;

a paint roller; and means for handling said paint roller, said handling means including a rod having a first end on which the paint roller is mounted and a second end provided with grip means, said rod being bent to form a U-shaped portion including a linear base adapted to be positioned into said linear groove and two legs which, when said linear base is positioned into the linear groove of the shielding part, lean on the second plate to prevent pivoting of the paint roller towards the side opposite to said linear edge;

whereby, in operation, said U-shaped portion having its linear base positioned into the linear groove cooperates with said linear groove and said second plate for guiding the paint roller while painting a portion of the second of said two substantially planar surfaces or applying said other coating on said portion of the second surface, which portion of the second surface being adjacent said corner and contiguous to said portion of the first surface, and that without smearing with paint or with said other coating the first surface having said portion thereof masked by the shielding part to thereby carry out said touch up.

9. A touch up device according to claim 8, wherein said shielding part is made in one piece.

10. A touch up device according to claim 9, wherein said shielding part is made of plastics and is obtained through an extrusion process.

11. A touch up device according to claim 8, wherein said paint roller has a longitudinal axis, and wherein said rod is bent so that its first end holds said roller in a position where the longitudinal axis of the latter is substantially perpendicular to said first plate when said linear base is positioned in said linear groove and said legs are leaned on said second plate.

* * * * *